US009929520B2

(12) United States Patent
Zhao

(10) Patent No.: US 9,929,520 B2
(45) Date of Patent: Mar. 27, 2018

(54) ELECTRICAL CONNECTOR HAVING IMPROVED CONDUCTIVE TERMINALS

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/623,406

(22) Filed: Jun. 15, 2017

(65) Prior Publication Data

US 2017/0365961 A1 Dec. 21, 2017

(30) Foreign Application Priority Data

Jun. 15, 2016 (CN) ..... 2016 1 0417800

(51) Int. Cl.
*H01R 24/60* (2011.01)
*H01R 13/6581* (2011.01)
*H01R 13/52* (2006.01)
*H01R 107/00* (2006.01)

(52) U.S. Cl.
CPC ..... *H01R 24/60* (2013.01); *H01R 13/5202* (2013.01); *H01R 13/6581* (2013.01); *H01R 2107/00* (2013.01)

(58) Field of Classification Search
CPC ..... H01R 24/60
See application file for complete search history.

(56) References Cited

U.S. PATENT DOCUMENTS

| | | | | |
|---|---|---|---|---|
| 9,673,552 | B2 * | 6/2017 | Tsai | H01R 13/405 |
| 9,680,254 | B1 * | 6/2017 | Nishikata | H01R 13/627 |
| 2009/0280663 | A1 * | 11/2009 | Yuan | H01R 4/02 439/79 |
| 2011/0281446 | A1 * | 11/2011 | Yu | H01R 4/02 439/92 |
| 2017/0201048 | A1 * | 7/2017 | Kong | H01R 13/6594 |
| 2017/0271823 | A1 * | 9/2017 | Zhao | H01R 13/6596 |

FOREIGN PATENT DOCUMENTS

| | | |
|---|---|---|
| CN | 203813082 U | 9/2014 |
| CN | 204118317 U | 1/2015 |
| CN | 204304072 | 4/2015 |
| CN | 105024197 A | 11/2015 |

* cited by examiner

*Primary Examiner* — James Harvey
(74) *Attorney, Agent, or Firm* — Wei Te Chung; Ming Chieh Chang

(57) ABSTRACT

An electrical connector includes: an insulative housing comprising a base portion and a tongue portion; and a row of conductive terminals retained to the insulative housing, the row of conductive terminals comprising a widened terminal, each conductive terminal having a contacting section exposed to a surface of the tongue portion, a tail section extending out of the insulative housing, and a retaining section connecting the contacting section and the tail section; wherein the widened terminal has a widened section extending laterally from a side of the contacting section and embedded in the tongue portion.

19 Claims, 10 Drawing Sheets

ELECTRICAL CONNECTOR HAVING IMPROVED CONDUCTIVE TERMINALS

BACKGROUND OF THE INVENTION

1. Field of the Invention

The present invention relates to an electrical connector, and more particularly to an electrical connector adapted for being normally and reversely mated with a complementary connector.

2. Description of Related Art

China Patent No. 105024197, issued on Nov. 4, 2015, discloses a USB connector based on a Type C. The USB connector comprises an insulative housing having a tongue portion, two rows of terminals exposed to the tongue portion, and a shell assembled to the insulative housing. In the molding processes of power terminals of the two rows of terminals, a contacting section of each power terminal is so formed by tearing the material to have a side section at a front thereof in order to widen the contacting section for large current conduction. An embedding section is formed at a front end of the contacting section. The tearing or shearing process is apt to damage the contacting section and/or the embedding section.

An electrical connector having a widened power terminal formed by thinning is desired.

SUMMARY OF THE INVENTION

An electrical connector comprises: an insulative housing comprising a base portion and a tongue portion; and a row of conductive terminals retained to the insulative housing, the row of conductive terminals comprising a widened terminal, each conductive terminal having a contacting section exposed to a surface of the tongue portion, a tail section extending out of the insulative housing, and a retaining section connecting the contacting section and the tail section; wherein the widened terminal has a widened section extending laterally from a side of the contacting section and embedded in the tongue portion.

Other novel features of the invention will become more apparent from the following detailed description when taken in conjunction with the accompanying drawings.

DETAILED DESCRIPTION OF THE PREFERRED EMBODIMENT

Figure 1:
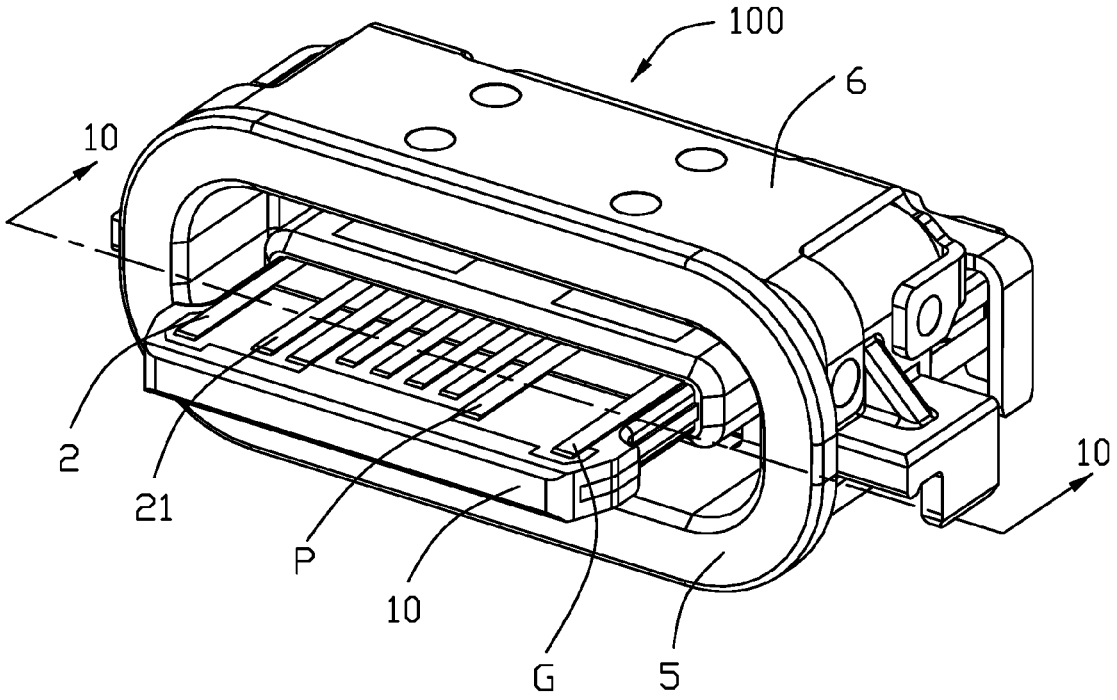
FIG. 1 is an assembled perspective view of the electrical connector of a preferred embodiment of the instant invention.
Figure 2:
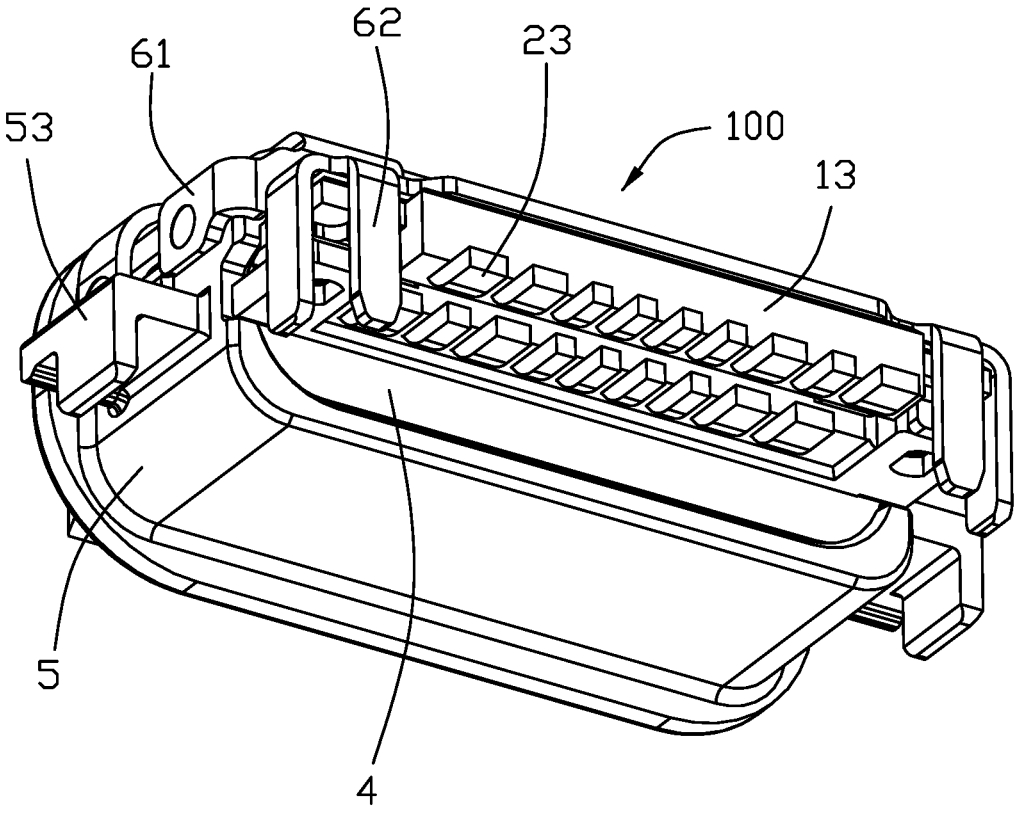
FIG. 2 is an assembled perspective view of FIG. 1 seen from another direction.
Figure 3:
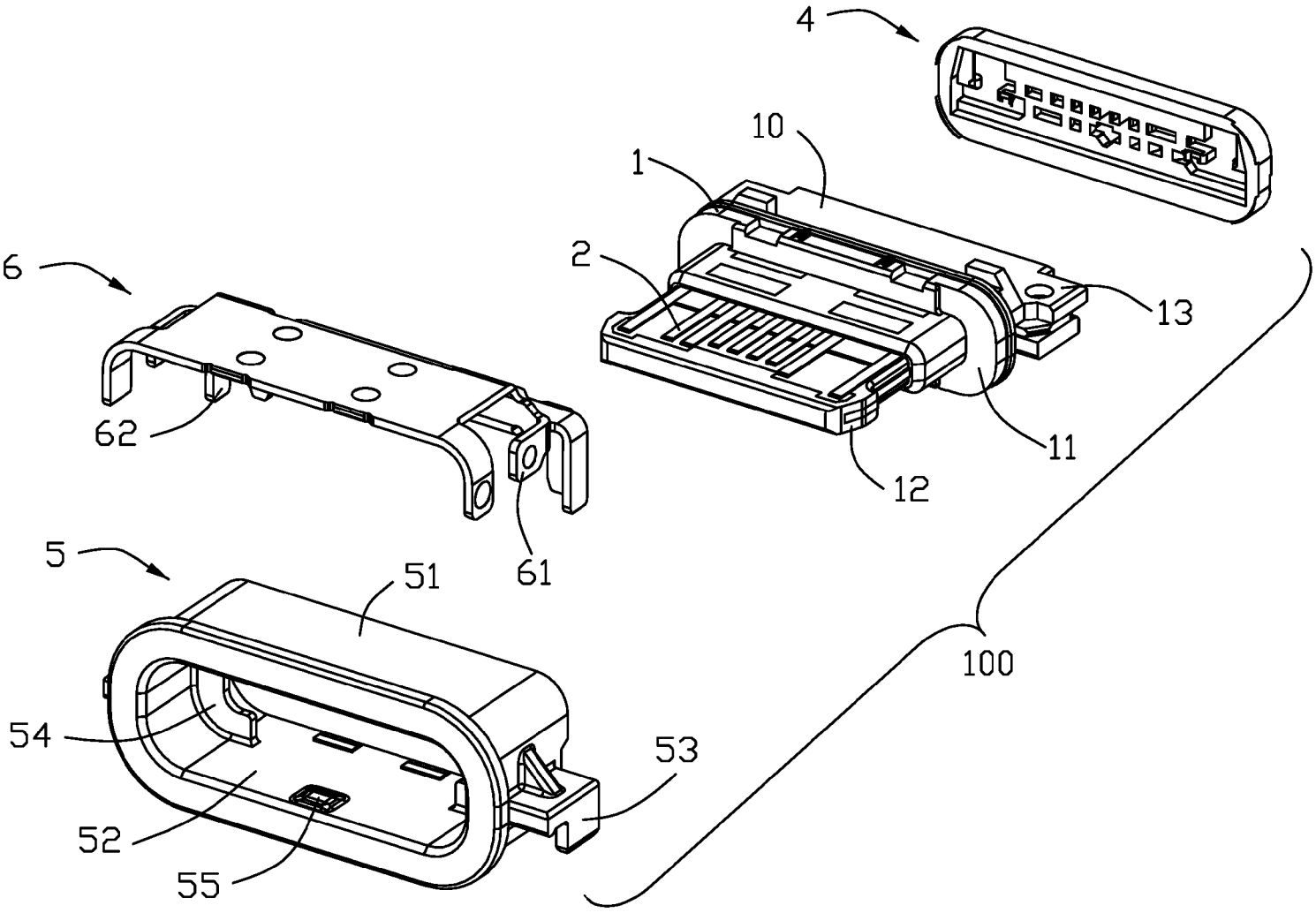
FIG. 3 is a partially exploded perspective view of the electrical connector of a preferred embodiment of the instant invention.
Figure 4:
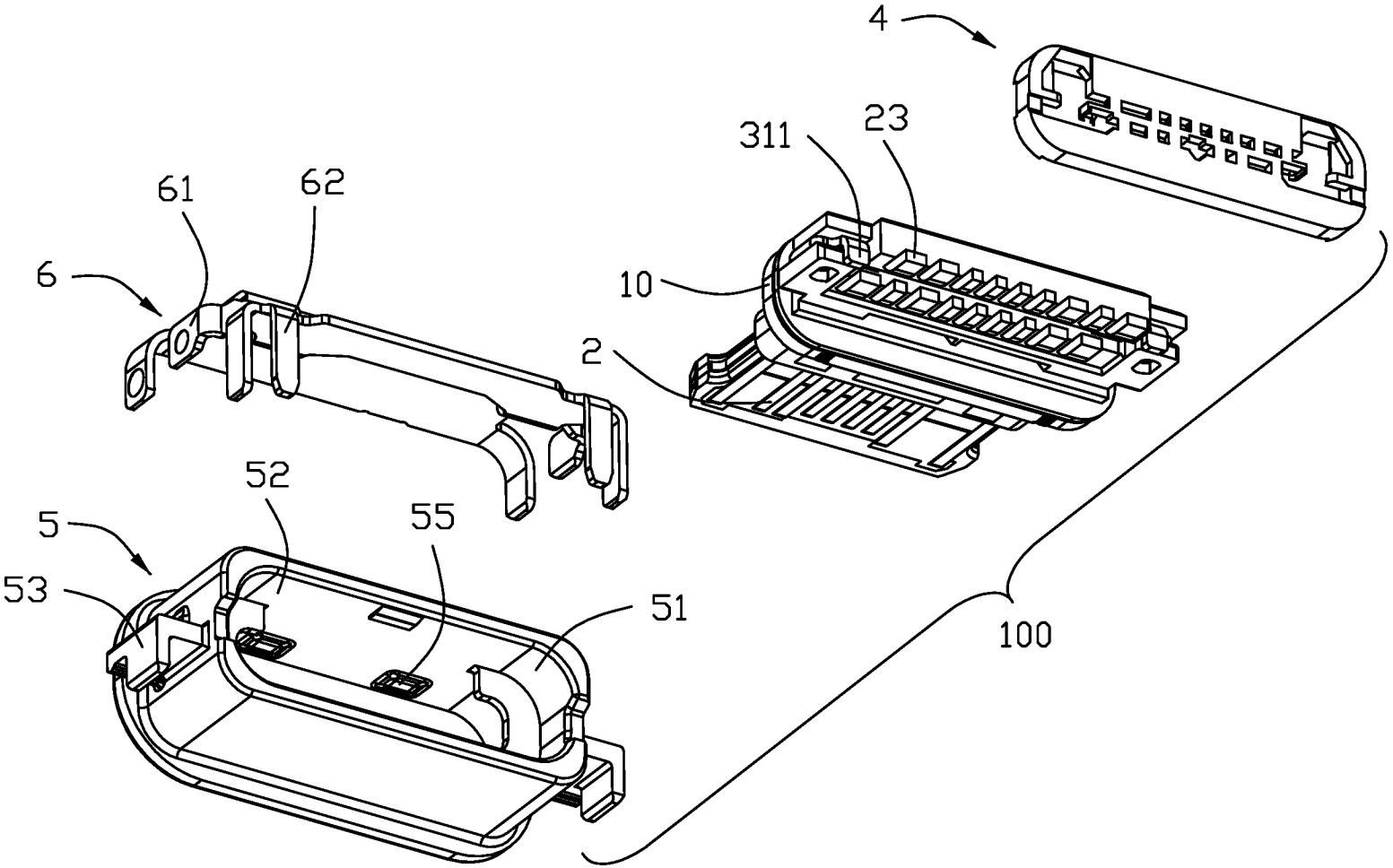
FIG. 4 is a partially exploded perspective view of FIG. 3 seen from another direction.
Figure 5:
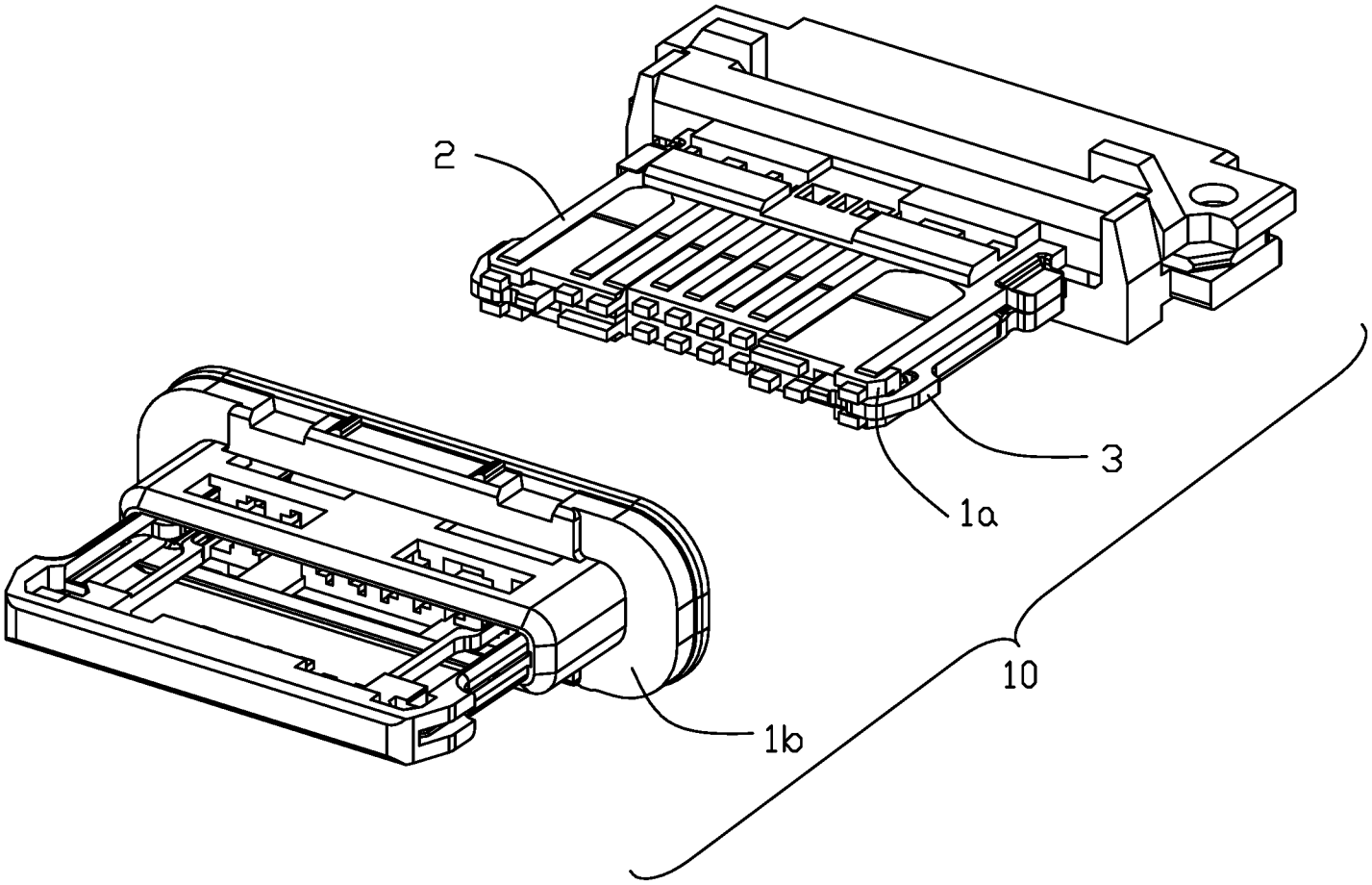
FIG. 5 is a partially exploded perspective view of the terminal module of FIG. 4.
Figure 6:
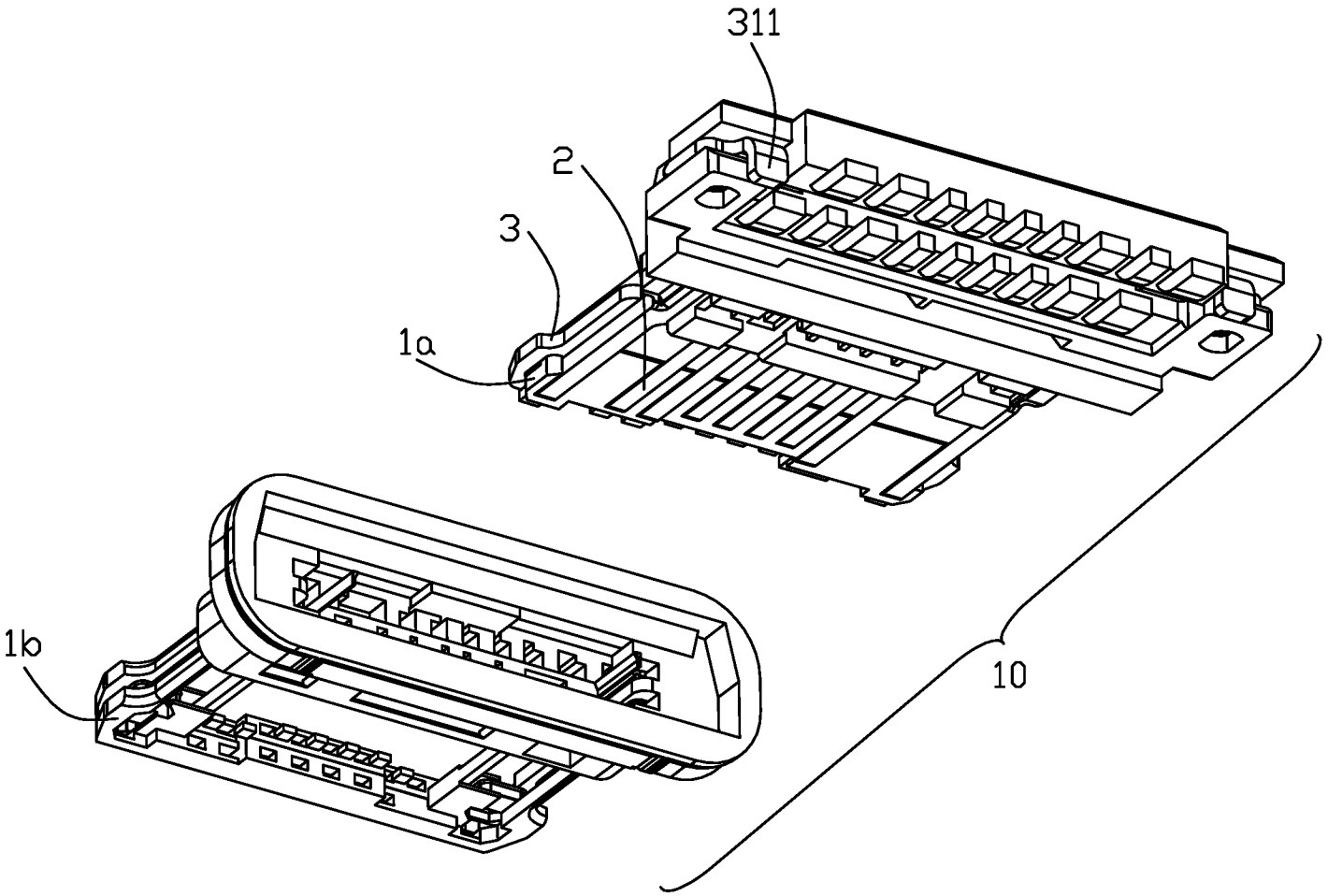
FIG. 6 is a partially exploded perspective view of FIG. 5 seen from another direction.
Figure 7:
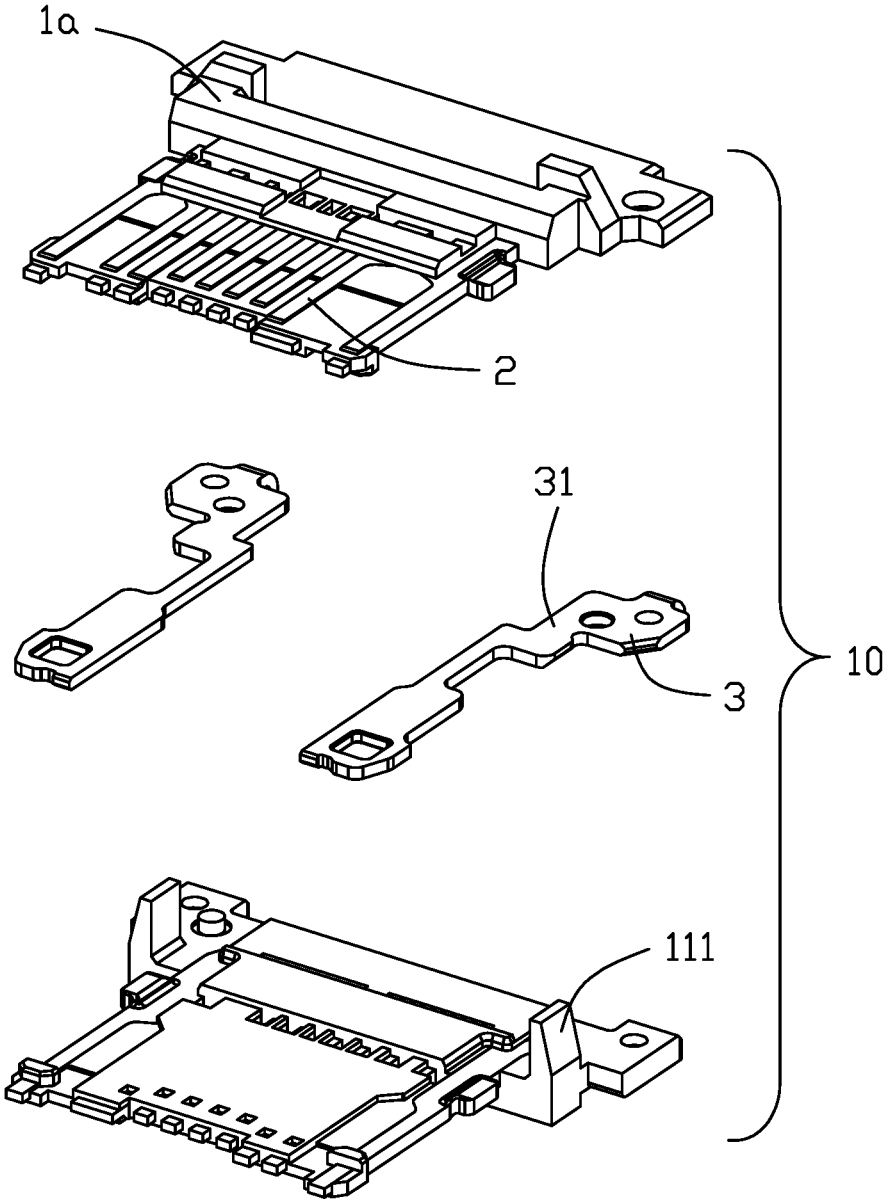
FIG. 7 is a partially exploded perspective view of further exploded of the terminal module without a insulator of FIG. 5.
Figure 8:
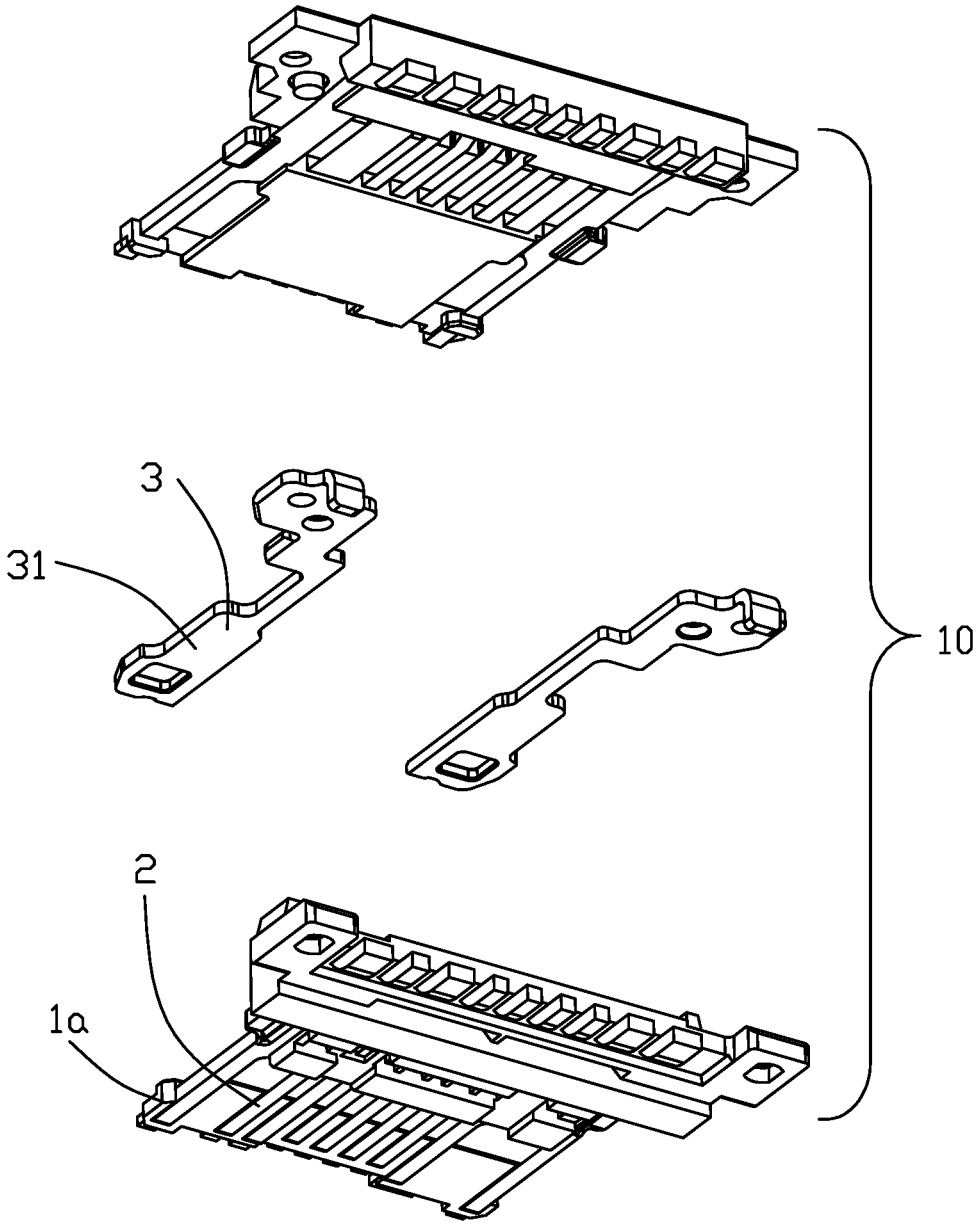
FIG. 8 is a partially exploded perspective view of FIG. 7 seen from another direction.

Reference will now be made in detail to the preferred embodiment of the present invention shown in FIGS. 1 to 10.

The electrical connector 100 has an insertion opening (not labeled) to mate a complementary plug connector (not shown). The electrical connector 100 has a front-to-rear direction, a transverse direction perpendicular to the front-to-rear direction, and a vertical direction perpendicular to both the front-to-rear direction and the transverse direction, respectively. The electrical connector 100 defines the insertion opening at the front end thereof.

The electrical connector 100 of a preferred embodiment of the instant invention is a receptacle connector. The electrical connector 100 includes an insulative housing 1, two rows of conductive terminals 2 retained to the insulative housing 1 and positioned to have 180 degree symmetry, a metallic shielding plate 3, a sealer 4, a shielding shell 5 assembled to a outside of insulative housing 1, and a metallic shell 6 retained to a outside of the shielding shell 1.

The insulative housing 1 includes a base portion 11, a tongue portion 12 extending forwardly from the base portion 11 in the front-to-rear direction, and a tail 13 located at a rear end of the base portion 11.

Each row of conductive terminals 2 include a plurality of grounding terminals G located on both sides of the tongue portion 12 along a transverse direction, a plurality of power terminals P, a plurality of signal terminals (not labeled), and a plurality of other functional terminals (not labeled). The power terminals P, the signal terminals, the other functional terminals are located on the inside of one of the grounding terminals G Each conductive terminal 2 includes a contacting section 21 exposed to a surface of the tongue portion 12, a tail section 23 extending out of the insulative housing 1, a retaining section 22 connecting the contacting section 21 and the tail section 23, and an embedding section 26 extending from the front end of the contacting section 21. Each row of conductive terminals 2 have a widened terminal (20A, 20B). Each widened terminal (20A, 20B) of the preferred embodiment of the present invention is used to be a power terminal P. The widened terminal (20A, 20B) further includes a widened section 24 extending laterally from a side of the contacting section 21 and embedded in the tongue portion 12. The widened section 24 of the widened terminal (20A, 20B) defines a first thickness and a first width. The contacting section 21 of the widened terminal (20A, 20B) defines a second thickness and a second width. The first thickness is less than the second thickness. The widened section 24 and the embedding section 26 are connected together. The widened section 24 is coplanar with the embedding section 26. The sum of the first width and the second width is larger than a width of each other conductive terminals 2, that is, the width of each contacting section 21 of the grounding terminal G, the signal terminal, or other functional terminal. The retaining section 22 of the widened terminal (20A, 20B) defines a third width equal to the sum of the first width and the second width. The widened section 24 and the retaining section 22 of the widened terminal (20A, 20B) are formed in a stepped sharp. Each grounding terminal G is provided with a laterally projecting soldering section 25.

The metallic shielding plate 3 includes a pair of flakes 31 which are provided separately. Each flake 31 includes a grounding leg 311 extending downwardly from the rear end thereof. As well known in the field and clearly shown in the drawing, each flake 31 has a locking notch (not labeled) exposed upon a lateral side of the tongue portion of latching the complementary plug connector.

The shielding shell 5 includes a main portion 51, a receiving cavity 52 surrounded by the main portion 51, a pair of support portions 53 provided on both sides of the main portion 51, a stopping portion 54 provided into the receiving cavity 52, a plurality of grounding tubers 55 protruding from the main portion 51 toward the receiving cavity 52 to contact the complementary connector.

The metallic shell 6 includes a pair of bend portions 61 formed by lateral bending and a plurality of securing legs 62 extending downwardly from the metallic shell 6.

The method of manufacturing the electrical connector 100 of the preferred embodiment of the instant invention includes the following steps:

A part of a front end of each conductive terminal 2 is thinned to form the embedding section 26. A part of a front end of each power terminal P is thinned to form the embedding section 26 and the widened section 24. The two rows of conductive terminals 2 are diagonally symmetrically arranged with each other. One row of conductive terminals 2 is integrated with one of two body portions 1*a*. Another row of the conductive terminals 2 is integrated with another body portion 1*a*. The embedding sections 26 and the widened sections 24 are retained in the tongue portion 12. The pair of flakes 31 are resisted respectively between the upper and lower grounding terminals G on both sides along the vertical direction. One body portion la includes a pair of locking arms 111 which are locked with both sides of another body portion 1*a*. The two body portions 1*a* and the pair of flakes 31 are snap-fitted by a plurality of protruding cylinders (not labeled) of the body portions 1*a* and a plurality of holes (not labeled) of the flakes 31. The soldering section 25 of each upper grounding terminal G is soldered together with the soldering section 25 of each lower grounding terminal G An insulator 1*b* is integrated with the two body portions 1*a* provided with the metallic shielding plate 3 and the conductive terminals 2 to form a terminal module 10. In the terminal module 10, a bottom surface of the contacting section 21 of each power terminal P and another bottom surface of the widened section 24 of each power terminal P are close to the thickness center of the tongue portion 12 and coplanar with each other. The tail sections 23 of the two rows of the conductive terminals 2 are arranged in two rows on the tail 13 of the insulative housing 1 in the front-to-rear direction.

The shielding shell 5 is metal injection molding. The terminal module 10 is mounted in the receiving cavity 52 of the shielding shell 5. The terminal module 10 resists forwardly against the stopping portion 54. The sealer 4 seals up the gap between the rear end of the terminal module 10 and the inside of the shielding shell 5. The metallic shell 6 is soldered to the outer surface of the shielding shell 5. The pair of bend portions 61 are fastened to the both sides of the main portion 51 in the transverse direction.

Each power terminal P increases the width of the power terminal P by setting the widened section 24, thereby enhancing the heat dissipation area to facilitate passing through the large current. Each widened section 24 is embedded/retained/hidden in the tongue portion 12 instead of being exposed to the surface of the tongue portion 12 so as to conform to the width of the contacting section specified by the standard USB Type C and avoid mistakenly mating with the incorrect terminals of the complementary plug connector other than for power delivery during mating. In the prior art, the widths of the retaining section 22 and the tail section 23 of the widened terminal (20A, 20B) are widened, but the width of the contacting section 21 is not widened due to the concern of being inadvertently connected to the complementary plug connector during mating, such that in the prior art the resistance of the contacting section is larger than those of the retaining section 22 and the tail section 23 to thereby not only prohibit the relatively larger power delivery according to the formula $P_{power}=I_{current}*V_{voltage}=(V_{voltage}/R_{resistance})*V_{voltage}=V^2/R$ wherein V is predetermined/constant, but also generate more heat but with inferior/less capability of heat dissipation. However, the contacting section 21, the retaining section 22, and the tail section 23 of the widened terminal (20A, 20B) of the preferred embodiment of the instant invention are all widened for not only decreasing the resistance along the terminal length but also reducing the heat generated with relatively larger areas for efficient heat dissipation. The widened section 24 is formed by thinning a part of the front portion of the power terminal P, and the manufacturing process is easy and the contacting section 21 of the power terminal P is not damaged during the manufacturing process. The thickness of the contacting section 21 may be provided as desired, thereby being conducive to expand the heat dissipation area to facilitate passing through the large current.

In other embodiments of the instant invention, the grounding terminals G and/or the other conductive terminals can be provided with the widened section 24 of the preferred embodiment of the instant invention. Anyone of the power terminals P, the grounding terminals G, or the other conductive terminals 2 which is having the widened section 24 may be collectively referred to as a widened terminal (20A, 20B). Of course, the opportunities the power terminals P and/or the grounding terminals G to transmit the large current are more, with greater possibilities to provide with the widened section 24. Understandably, the tongue portion 12 includes main thinner section (not labeled) and a rear thicker section (not labeled) around its root, and the contacting section 21 of the terminal 2 is exposed upon the main thinner section only while the retaining section 22 of the terminal 2 is hidden within the rear thicker section and the base portion 11.

In this embodiment, the widened section may be either applied to the contacting section 21 corresponding to the aforementioned main thinner section as long as the widened section is embedded within the main thinner section, or applied to the retaining section 22 corresponding to the rear thicker section and the base portion 11 as well, wherein the former requires to have such a widened section thinner than the original contacting section 21 so as to be hidden behind the mating surface of the main thinner section of the tongue portion 12 for not inappropriately and mistakenly contact the neighboring plug terminal which is located adjacent to the correct corresponding plug terminal, while the latter may keep the same thickness with the original retaining section 22 because of no exposure thereof for mating. In this embodiment, because a vacant space is formed between the power terminal and the grounding terminal without any corresponding terminals therein, the widened section is formed in such a vacant space. Understandably, the thinning thickness of the widened section is only to have an offset region in the vertical direction for not being exposed upon the mating surface. Therefore, it may be okay to have the widened section keep the same thickness with the contacting section but in an offset manner in the vertical direction for not being exposed upon the mating surface alternately.

Figure 10:
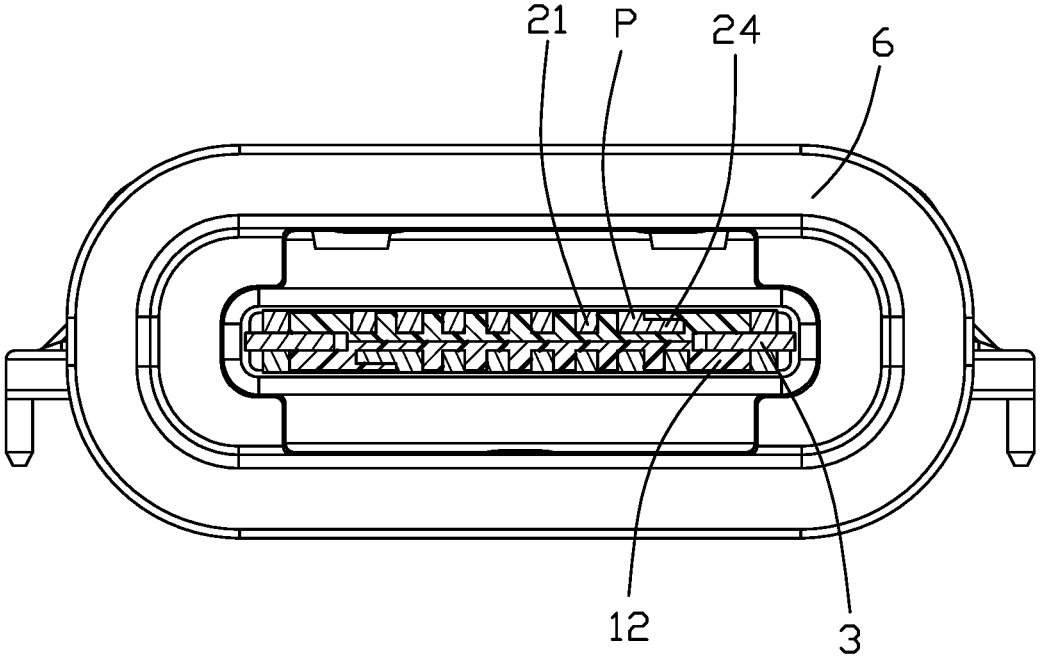
FIG. 10 is a cross-sectional view of the electrical connector of a preferred embodiment of the instant invention taken along line 10-10 of FIG. 1.

Another feature of the invention is that the thickness of the terminals 2 is relatively larger than that of the traditional Type C connector for enhancing conductivity thereof so that the distance between the upper row terminals 2 and the lower row terminals 2 is essentially equal to a thickness of the shielding plate 3, as shown in FIG. 10. It is because the shielding plate 3 is essentially of a pair of flakes 31 at two opposite lateral sides with a large space therebetween in the transverse direction so that there is no shorting risk with the shielding plate 3 for the terminals 2 in the instant invention, compared with the traditional Type C connector having the complete planar shielding plate between the two rows of terminals. Notably, in this embodiment the thickness of the terminal 2 is larger than that of the shielding plate 3.

It is also noted that, as the regular type C connector, because the shielding plate 3 requires to provide the retention function with the complementary plug connector, the material of the shielding plate 3 is different from that of the terminals 2 inherently. In other words, the terminals 2 are made of brass for good conductivity thereof while the shielding plate is made of steel for good rigidity thereof wherein the steel is more rigid than the brass.

Figure 9:
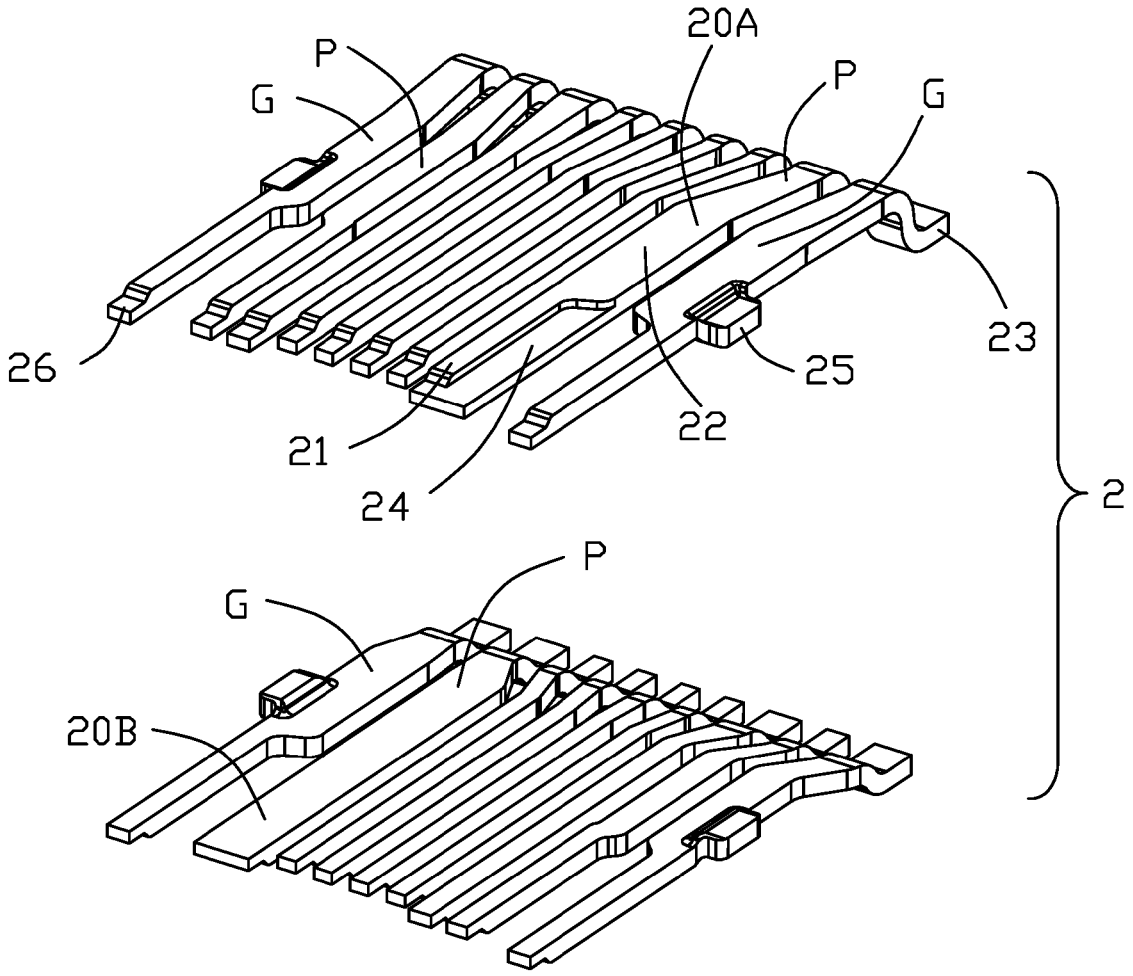
FIG. 9 is an exploded perspective view of two rows of conductive terminals of the electrical connector of a preferred embodiment of the instant invention.

It is also noted that as shown in FIG. 9 even though the contacting outer surface of the contacting section of the widened/power terminal 20A/20B form an offset/step structure, all the inner surface of contacting section of the widened/power terminal 20A and 20B in the tongue portion, keeps coplanar along the front-to-back direction, thus assuring no shorting risk with the neighboring terminals in the other row. Notably, such coplanarity extends to the retaining section in the base portion.

It is to be understood, however, that even though numerous characteristics and advantages of the present invention have been set forth in the foregoing description, together with details of the structure and function of the invention, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a base portion and a tongue portion; and a row of conductive terminals retained to the insulative housing, the row of conductive terminals comprising a widened terminal, each conductive terminal having a contacting section exposed to a surface of the tongue portion, a tail section extending out of the insulative housing, and a retaining section connecting the contacting section and the tail section;

wherein the widened terminal has a widened section extending laterally from a side of the contacting section and embedded in the tongue portion; and another row of conductive terminals, and wherein the two rows of conductive terminals are positioned to have 180-degree symmetry.

2. The electrical connector as claimed in claim 1, wherein said widened section is formed by thinning a part of a front end thereof, and a non-thinned part forms the contacting section of the widened terminal.

3. The electrical connector as claimed in claim 1, wherein said widened terminal is adapted to be a power terminal or a grounding terminal.

4. The electrical connector as claimed in claim 1, wherein each conductive terminal comprises an embedding section extending at a front end of the contacting section and embedded in the tongue portion, the widened section of the widened terminal is connected to the embedding section, the widened section is coplanar with the embedding section, and the widened section and the embedding section are formed jointly by thinning the part of the front end of the widened terminal.

5. The electrical connector as claimed in claim 1, wherein said widened section of the widened terminal defines a first thickness and a first width, the contacting section of the widened terminal defines a second thickness greater than the first thickness and a second width, the sum of the first width and the second width is larger than that of each contacting section of other conductive terminals.

6. The electrical connector as claimed in claim 5, wherein said retaining section of widened terminal defines a third width equal to the sum of the first width and the second width, the widened section and the retaining section of the widened terminal are formed in a stepped shape.

7. The electrical connector as claimed in claim 1, wherein a bottom surface of the contacting section of the widened terminal and another bottom surface of the widened section of the widened terminal are close to a thickness center of the tongue portion and coplanar with each other, a top surface of the contacting section of the widened terminal is far away from the thickness center of the tongue portion and higher than another top surface of the widened section of the widened terminal which is far away from the thickness center of the tongue portion.

8. An electrical connector for use with a complementary plug connector, comprising:

an insulative housing including a base portion and a tongue portion extending forwardly from the base portion, said tongue portion including a main thinner section and a rear thicker section along a front-to-back direction, the main thinner section forming a pair of opposite mating surfaces in the vertical direction perpendicular to said front-to-back direction;

two rows of terminals disposed in the housing, each said terminals including a front contacting section, a rear tail section and a retaining section between the contacting section and the tail section, the front contacting section being exposed upon the corresponding mating surface;

a pair of metallic flakes discrete from and located between the two rows of terminals in the vertical direction and spaced from each other in a transverse direction perpendicular to both said front-to-back direction and said vertical direction, each of said flakes forming a locking notch exposed upon a corresponding lateral side of the tongue portion; and in each row of terminals, an interval between every adjacent two terminals measured along said transverse direction, being not all equal, and at least one vacant space formed between two outermost adjacent terminals of which one is an outer grounding terminal and the other is an inner power terminal; wherein the inner power terminal includes a widened section extending laterally toward the outer grounding terminal in the transverse direction to occupy said vacant space, and an outer surface of said widened section is offset from that of the contacting section of the inner power terminal in the vertical direction for not being exposed upon the corresponding mating surface for not mistakenly contacting corresponding contacts of the complementary plug connector.

9. The electrical connector as claimed in claim 1, further comprising a metallic shielding plate, and wherein the two rows of conductive terminals are fixed to the upper and lower ends of the insulative house, each row of conductive terminals comprise a plurality of grounding terminals located on both sides of the tongue portion along a transverse direction, and the metallic shielding plate has a pair of flakes each disposed between an upper ground terminal and a lower ground terminal of the two rows of conductive terminals along a vertical direction.

10. An electrical connector for use with a complementary plug connector, comprising:

an insulative housing including a base portion and a tongue portion extending forwardly from the base portion, said tongue portion including a main thinner section and a rear thicker section along a front-to-back direction, the main thinner section forming a pair of opposite mating surfaces in the vertical direction perpendicular to said front-to-back direction;

two rows of terminals disposed in the housing, each said terminals including a front contacting section, a rear tail section and a retaining section between the contacting section and the tail section, the front contacting section being exposed upon the corresponding mating surface; and in each row of terminals, an interval between every adjacent two terminals measured along said transverse direction, being not all equal, and at least one vacant space formed between two outermost adjacent terminals of which one is an outer grounding terminal and the other is an inner power terminal; wherein the inner power terminal includes a widened section extending laterally toward the outer grounding terminal in a transverse direction perpendicular to both said front-to-back direction and said vertical direction to occupy said vacant space, and an outer surface of said widened section is offset from that of the contacting section of the inner power terminal in the vertical direction for not being exposed upon the corresponding mating surface for not mistakenly contacting corresponding contacts of the complementary plug connector; wherein a thickness of the widened section is smaller than that of the contacting section of the inner power terminal in the vertical direction.

11. The electrical connector as claimed in claim 8, wherein a thickness of the widened section is less than that of the contacting section of the corresponding terminal in the vertical direction.

12. The electrical connector as claimed in claim 11, wherein an inner surface of the contacting section and that of the widened section are coplanar along a horizontal plane.

13. The electrical connector as claimed in claim 12, wherein an inner surface of the retaining section of the inner power terminal is coplanar with those of said contacting section and said widened section in said horizontal plane.

14. The electrical connector as claimed in claim 8, wherein a thickness of the contacting section of the inner power terminal is larger than that of the flake in the vertical direction.

15. The electrical connector as claimed in claim 8, wherein the contacting sections of all the terminals have a same thickness, and the contacting sections of each terminals has an embedded section at a front free end.

16. The electrical connector as claimed in claim 14, wherein a thickness of the embedded section is equal to that of the widened section in the vertical direction.

17. The electrical connector as claimed in claim 8, wherein the retaining section and the tail sections of the inner power terminal are wider in the transverse direction compared with those of other terminals.

18. The electrical connector as claimed in claim 10, wherein each said terminals includes an embedded section at a front free end, and a thickness of said embedded section is similar to that of the widened section.

19. The electrical connector as claimed in claim 18, wherein the widened section and the embedded section of said inner power terminal are directly and unitarily linked to each other in a coplanar manner.

* * * * *